United States Patent [19]

De Marco

[11] 4,183,100

[45] Jan. 15, 1980

[54] SPECIALTY GLOVE

[76] Inventor: Alexander H. De Marco, 85 Maple Ave., Shelton, Conn. 06484

[21] Appl. No.: 972,054

[22] Filed: Dec. 20, 1978

[51] Int. Cl.[2] ..... A41D 19/00

[52] U.S. Cl. ..... 2/159; 2/161 A; 2/164

[58] Field of Search ..... 2/159, 161 R, 161 A, 2/164, 167, 168

[56] References Cited

U.S. PATENT DOCUMENTS

| | | | |
|---|---|---|---|
| 645,406 | 3/1900 | Potter | 2/161 R |
| 964,608 | 7/1910 | Chaddock et al. | 2/161 R |
| 2,465,136 | 3/1949 | Troccoli | 2/161 A |
| 3,748,792 | 7/1973 | Lamb | 2/161 R X |
| 3,835,472 | 9/1974 | Duggins | 2/161 A |

FOREIGN PATENT DOCUMENTS

| | | | |
|---|---|---|---|
| 551764 | 7/1974 | Switzerland | 2/161 A |

*Primary Examiner*—H. Hampton Hunter
*Attorney, Agent, or Firm*—Walter Spruegel

[57] ABSTRACT

Glove is open on one end and is provided in its other end and in one side with first and second apertures through which to project the fingers and the thumb, respectively, of a hand in slipping the glove onto the hand, with the glove also having a friction patch in cover relation with the palm of the wearer's hand.

2 Claims, 7 Drawing Figures

SPECIALTY GLOVE

This invention relates to gloves in general, and to specialty gloves in particular.

Gloves are worn by many who are required to exert a firm hand grip in the course of their work, as in swinging an axe or moving furniture, for example, or in the pursuit of sports, such as in swinging a baseball bat, golf club or tennis racket, for example. While such "specialty" gloves do lend a firmer and more secure grip to the wearers' hands by keeping perspiration from the gripped objects in any event or by using gloves of leather or other good gripping material, their enhanced grip is invariably at the expense of dexterity and freedom of action of the sheathed hands which is often a handicap in many activities especially, but by no means exclusively, in the field of sports. This is due to the fact that most of the gloves thus used do not distinguish from, and are in fact of, the conventional kinds found in stores which deal in wearing apparel, i.e., gloves which sheath an entire hand, including the fingers and thumb, and appeal to most customers for their warmth and/or well-tailored appearance.

It is a primary object of the present invention to provide a specialty glove of a type which not only affords to the wearer a firm and secure grip on objects at all times, but also leaves the wearer's hand with its natural dexterity and freedom of action as much so as if no glove were worn. To this end, the glove is fashioned to fit primarily over the palm of a hand but not over the fingers and thumb thereof, and the glove is not only impervious to moisture such as perspiration, but it also at least over a grip area of the so-called "palm" part of the glove of a material of good gripping performance. In so fabricating the glove, the wearer's palm, being the most perspiring part and also forming the predominant grip area of the wearer's hand, is effectively insulated from, and also held in firm non-slip fashion on, a gripped object through intermediation of the worn glove, while the wearer's hand retains its full dexterity and freedom of action by virtue of the exposure of the wearer's thumb and fingers.

It is another object of the present invention to provide a specialty glove of the aforementioned type which fits and can be worn equally effectively on either a right hand or a left hand. To this end, the glove is formed in two halves which in non-use of the glove are in superposed disposition in which they are congruent throughout and, hence, to the inclusion of the edges of the apertures through which the thumb and fingers are passed in slipping the glove onto a right hand or left hand, and each of these glove halves is formed of a material of good gripping performance over an area which is the aforementioned grip area of the glove in either right-hand or left-hand wear of the same.

Further objects and advantages will appear to those skilled in the art from the following, considered in conjunction with the accompanying drawings.

In the accompanying drawings, in which certain modes of carrying out the present invention are shown for illustrative purposes:

Figures 1, 2, 3, 4, 5, 6, 7:
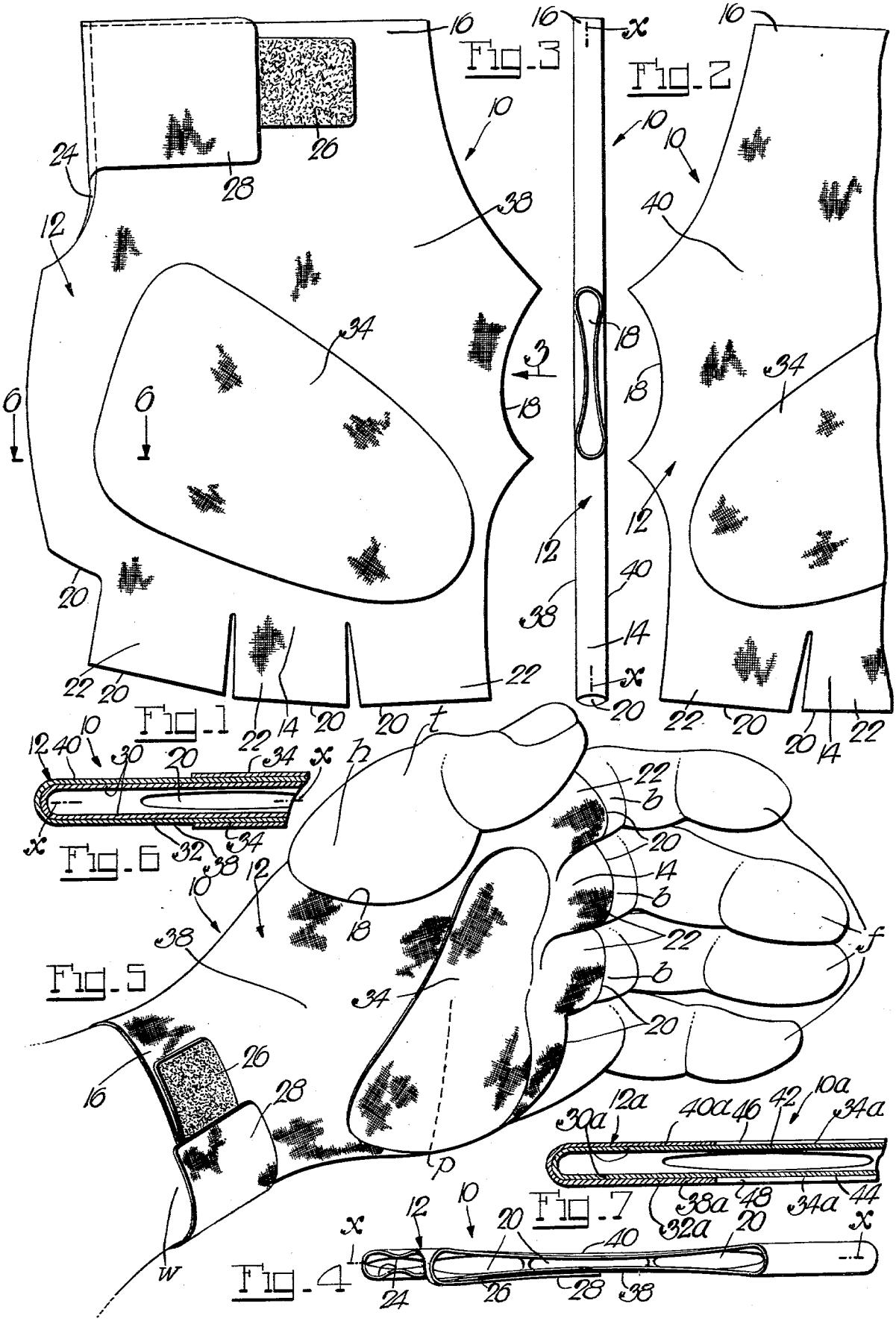
FIG. 1 is a side view of a specialty glove embodying the invention.
FIG. 2 is an opposite side view of the same glove.
FIG. 3 is a view of the specialty glove as seen in the direction of the arrow 3 in FIG. 1.
FIG. 4 is a top view of the specialty glove.
FIG. 5 is a perspective view of the specialty glove as worn on a hand which in this instance is a left hand.
FIG. 6 is an enlarged fragmentary section through the specialty glove as taken on the line 6—6 of FIG. 1.
FIG. 7 is an enlarged fragmentary section through a glove embodying the invention in a modified manner.

Referring to the drawings, the reference numeral 10 designates a glove which has as its main component a sheath 12 that is tubular, being closed on all sides at one end 14 and open at its other end, and being adapted for slip, with its open end leading, onto the palm part p of a hand h in fit therewith (FIG. 5). The sheath 12 is on one side and at its closed end 14 provided with apertures 18 and 20 through which to pass the thumb t and fingers f, respectively, of a hand on the slip of the sheath 12 onto the palm part p thereof. Preferably, the finger apertures 20, with the exception of one of them in this instance, are provided by tubular extensions or stubs 22 of the sheath 12 which fittedly receive the bases b of three of the fingers f of a wearer's hand. The sheath 12 preferably extends with its open end 16 to, and preferably somewhat over, a wearer's wrist w (FIG. 5) which is there slit as at 24 so that this sheath end 16 may be further opened for its ready slip onto a hand, with this sheath end being closable on a wearer's wrist by a Velcro pad 26 and a cooperating flap 28.

The sheath 12 is formed of an inner ply 30 of a preferably knitted fabric and an outer ply 32 of a preferably woven fabric (FIG. 6), with these plies 30 and 32 being laminated in any suitable manner, as by applying a coating of latex to the confronting faces of these plies and then pressing them together, for example. The fabric plies 30 and 32 are also stretchable and somewhat resilient so that the sheath 12 has the same properties of stretchability and resiliency.

The sheath 12 is also provided with an exposed patch 34 which is suitably bonded to the outer sheath ply 32 (see also FIG. 6), and is located and of a size and shape to be in substantial cover relation with a wearer's palm. The patch 34 is in the nature of a grip pad, being of any suitable friction material, such as a latex-coated woven fabric, for example, for good grip performance by the wearer's hand.

The present glove is a specialty glove to be worn for a good hand grip on all kinds of objects. Thus, the glove may be worn in the course of work, such as swinging an axe or moving furniture, for example, or in the course of sport activities, such as swinging a baseball bat, golf club or tennis racket, for example. The glove lends a good grip to a wearer's hand not only through intermediation of the friction pad 34 thereof, but also because the glove is impervious to perspiration of the wearer's hand, with such perspiration being heaviest over the wearer's palm which is well covered by the glove, and being much less and virtually negligible over the wearer's exposed thumb and fingers. The sheath 12 is impervious to moisture, such as perspiration, by coating or impregnating the outer woven ply 32 with any suitable moisture-impervious substance, such as latex, for example.

The glove is highly advantageous in that it not only affords a good hand grip when needed in the course of work or sports, but also retains the full dexterity and freedom of action of the wearer's hand so much so as if no glove were worn. This is due to the fact that the sheath affords an ideal grip and perspiration-impervious area over a wearer's palm, but leaves the thumb and fingers exposed for their accustomed dexterity and freedom of action unhampered by the worn glove.

The present glove is still further advantageous in that the same lends itself for equally ready and comfortable wear on either a right hand or a left hand. To this end, the sheath 12 is formed in two halves 38 and 40 which in non-use of the sheath are in superposition in a common plane x in which they are congruent (FIGS. 1 to 3), and the thumb and finger apertures 18 and 20 in the sheath are symmetrical about the plane x. Further, the sheath 12 is provided on its halves 38 and 40 with identical friction patches 34 (FIGS. 1,2 and 6) which in superposition of these halves 38 and 40 are also congruent.

Reference is now had to FIG. 7 which shows a modified glove 10*a* of which the friction patches 34*a* on the opposite halves 38*a* and 40*a* of the sheath 12*a* are formed by parts 42 and 44 of the inner knitted ply 30*a*, with these ply parts 42 and 44 being exposed through cut-out windows 46 and 48, respectively, in the outer ply 32*a*. These exposed inner ply parts 42 and 44 have good friction characteristics by being coated with any suitable substance of a high coefficient of friction such as latex, for example.

What is claimed is:

1. A specialty glove, providing a longitudinal sheath formed of laminated inner and outer plies of knitted and woven fabrics, respectively, said sheath being closed on all sides and at one end and open at the other end, and adapted for slip, with its open end leading, onto the palm part of a hand in fit therewith, said sheath also having in one of said sides and in said closed end first and second apertures through which to pass the thumb and fingers, respectively, of a hand on the slip of said sheath onto the palm part thereof so that the thumb and fingers of a wearer's hand are exposed, and said outer ply having a cut-out window through which is exposed a part of said inner ply in cover relation with a wearer's palm, with said exposed inner ply part being coated with a friction material for good gripping performance.

2. A specialty glove as in claim 1, in which said coating on said exposed inner ply part is a latex coating.

* * * * *